US007467688B2

(12) United States Patent
Ducharme

(10) Patent No.: US 7,467,688 B2
(45) Date of Patent: Dec. 23, 2008

(54) MULTI-COMPOSITE ACOUSTIC PANEL

(75) Inventor: Robert Ducharme, Ste-Anne-Des-Plaines (CA)

(73) Assignee: Royal Mat Inc., Quebec (CA)

( * ) Notice: Subject to any disclaimer, the term of this patent is extended or adjusted under 35 U.S.C. 154(b) by 393 days.

(21) Appl. No.: 10/544,319

(22) PCT Filed: Jan. 28, 2004

(86) PCT No.: PCT/CA2004/000112

§ 371 (c)(1),
(2), (4) Date: Jun. 20, 2006

(87) PCT Pub. No.: WO2004/067870

PCT Pub. Date: Aug. 12, 2004

(65) Prior Publication Data

US 2007/0137927 A1 Jun. 21, 2007

(30) Foreign Application Priority Data

Jan. 31, 2003 (CA) ..... 2418295

(51) Int. Cl.

| | |
|---|---|
| ***E04B 1/84*** | (2006.01) |
| ***E04B 1/82*** | (2006.01) |
| ***B32B 21/02*** | (2006.01) |
| ***B32B 5/16*** | (2006.01) |
| *E04B 1/74* | (2006.01) |
| *E04B 1/62* | (2006.01) |

(52) U.S. Cl. ..... 181/294; 181/286; 428/326; 428/292.4

(58) Field of Classification Search ..... 181/294, 181/290, 286, 284; 52/144, 145; 428/326, 428/292.4, 339, 511, 507

See application file for complete search history.

(56) References Cited

U.S. PATENT DOCUMENTS

| | | | | | |
|---|---|---|---|---|---|
| 2,550,143 | A | * | 4/1951 | Eger | 523/222 |
| 3,150,032 | A | * | 9/1964 | Rubenstein | 428/313.7 |
| 3,160,549 | A | * | 12/1964 | Caldwell et al. | 428/317.3 |
| 3,652,360 | A | * | 3/1972 | Hartman et al. | 156/244.11 |
| 4,109,041 | A | * | 8/1978 | Tellman | 428/147 |
| 4,272,572 | A | * | 6/1981 | Netherly | 428/35.5 |
| 4,339,362 | A | * | 7/1982 | Pascau | 524/5 |
| 4,663,224 | A | * | 5/1987 | Tabata et al. | 442/181 |
| 4,743,624 | A | * | 5/1988 | Blount | 521/106 |
| 4,923,034 | A | * | 5/1990 | Okuzawa et al. | 181/207 |

(Continued)

OTHER PUBLICATIONS

PCT Written Opinion of the International Searching Authority, PCT/CA2004/000112, filed Jan. 28, 2004.

*Primary Examiner*—Edgardo San Martin
(74) *Attorney, Agent, or Firm*—Darby & Darby PC

(57) ABSTRACT

A multi-composite acoustic panel for application to walls or ceilings. The panel is made from 15 to 65% of particles of sawdust with a granulometry of 4 to 60 mesh, 25 to 75% of rubber crumb or other petroleum derivatives or recycled rubber with a granulometry of 4 to 30 mesh and 3 to 20% of a polyurethane elastomer binder, the percentages being expressed by weight with relation to the total weight of the panel. In use the rubber acts as an anti-vibration element and the sawdust acts as an acoustic energy absorber as this type of fibre is hollow-centered which permits an absorption role which the rubber particle does not have. Said particle has the ability to reduce an impact.

19 Claims, 2 Drawing Sheets

U.S. PATENT DOCUMENTS 5,125,475 A * 6/1992 Ducharme et al. ..... 181/284
5,151,230 A * 9/1992 Damberg ..... 264/83
5,272,284 A * 12/1993 Schmanski ..... 181/210
5,814,170 A * 9/1998 Shibusawa et al. ..... 156/62.2
5,952,053 A * 9/1999 Colby ..... 427/393
6,122,877 A * 9/2000 Hendrickson et al. ..... 52/520
6,213,252 B1 * 4/2001 Ducharme ..... 181/293
6,514,889 B1 * 2/2003 Theoret et al. ..... 442/320
6,656,982 B2 * 12/2003 Yasuda et al. ..... 524/14
6,682,789 B2 * 1/2004 Godavarti et al. ..... 428/34
2002/0070074 A1 * 6/2002 Bongiovi ..... 181/207
2003/0125399 A1 * 7/2003 Zhang et al. ..... 521/40
2006/0124383 A1 * 6/2006 Yamada et al. ..... 181/200
2008/0029337 A1 * 2/2008 Alston ..... 181/294

* cited by examiner

MULTI-COMPOSITE ACOUSTIC PANEL

CROSS REFERENCE TO PRIOR APPLICATION

This is a U.S. national phase application under 35 U.S.C. 371 of International Patent Application No. PCT/CA2004/000112, filed Jan. 28, 2004, and claims benefit of Canadian Patent Application No. 2,418,295, filed Jan. 31, 2003 which is incorporated by reference herein. The International Application was published in French on Apr. 12, 2004 as WO 2004/067870 A1 under PCT Article 21(2).

BACKGROUND OF THE INVENTION

The invention relates to a multi-composite acoustic panel for use as a support in a floor or a wall, which panel is made of:

(a) particles of wood fibers from sawdust, (b) rubber crumb and/or other derivatives of petroleum or recycled rubber of a different granulometries, and (c) a polyurethane or elastomer based binder.

BRIEF SUMMARY OF THE INVENTION

The present invention is thus directed to an acoustic panel of the above-mentioned type, characterized in that it comprises more specifically:

15 to 65% of particles of sawdust with a granulometry of 4 to 60 mesh;

25 to 75% of rubber crumb or other petroleum derivatives or recycled rubber with a granulometry of 4 to 30 mesh; and 3 to 20% of a polyurethane or elastomer based binder such as the polyurethane binder G.N. 405 type G.T. or the binder S.L. 336 type G.T. from Polyval®, made of either isocyanate and alcohol or of polyvinyl acetate.

If need be, one may also incorporate into the composition of the panel between 3 and 8% of natural or synthetic fibers (polyethylene, polypropylene, polymer, polyurethane, fiberglass, mineral fibers, cellulose fibers, cork). One may also incorporate 3 to 20% of particles of metal such as bronze, copper or aluminum so as to give it radiant capacity. One can also add to it anti-fungal, water-repellent or anti-ant products or a fire-retardant product such as graphite. One can furthermore apply onto the panel an elastomeric membrane (neoprene, rubber and its derivatives).

It is worth noting that all the percentages given in the present specification are expressed by weight with respect to the total weight of the panel.

It is also worth noting that the granulometry of the particles of sawdust (a), crumb (b) and other elements eventually present can vary according to its need.

Thus, preferably, the percentages of base products used for the manufacturing of the panel can be as follows:

45 to 65% of particles of sawdust;

25 to 45% of rubber crumb; and 5 to 15% of a urethane based binder.

It will again be understood that these percentages can vary depending on the use of the acoustic product. Thus, depending on the floor finish that will be used on the product, a different hardness may be necessary. A semi-soft floor finish, such as vinyl tile or wood, will absorb the impacts much more than a hard finish such as ceramic or marble.

One will therefore note that the range of percentages given above can be more narrow in order to optimize the acoustic and mechanical performance of the panel.

The panel can be of varying dimensions 2'×2' (60 cm×60 cm); 4'×4' (120 cm×120 cm); 4'×6' (120 cm×180 cm), etc. and can be adapted to any kind of construction. Its thickness varies from ¼" to 1" (approximately 0.5 cm to 2.5 cm).

The multi-composite acoustic panel according to the invention is advantageously manufactured in a press by method of thermo-baking at a low temperature ranging between 100 and 350° F. (approximately 35° C. and 180° C.) under a low pressure ranging between 200 and 2000 PSI (approximately 1400 kN/m$^2$ and 14 000 kN/m$^2$), depending on the desired densification.

The panel can be manufactured in a single layer made of a homogeneous mixture of particles of sawdust, rubber crumb, rubber or other derivatives of petroleum, and binder (see FIG. 1 of the annexed drawings). Alternatively, it can be manufactured in several layers including a layer made strictly from sawdust interrelated to at least one other layer to form a panel. The latter is then made of different layers (see FIG. 2 of the drawings).

The panel that is so manufactured can be nailed, screwed, glued to the ground and can receive various floor finishes made of wood, ceramic, linoleum or stone.

It can also be laminated to other existing panels such as plywood panels, composite panels such as medium density fiberboards (MDF) or high density fiberboards (HDF), gypsum or cellulose boards.

Its two faces can be flat or one of its faces can have grooves of different configurations, as described by example in U.S. Pat. No. 6,213,252 issued on Apr. 10, 2001 in the name of the Applicant.

In fact, the invention essentially lies in incorporating different percentages of rubber crumb, other petroleum derivatives or recycled rubber to particles of sawdust and binding conjointly the particles of rubber and the sawdust with a binder chosen for acoustical optimization regarding impact noise and aerial noise.

In practice, the rubber acts as an anti-vibration element and the sawdust acts like an acoustical-energy absorbent element because this type of fiber is hollow in the center thereby giving it an absorptive role, which the particle of rubber does not have. This type of fiber therefore has the capacity of reducing impacts.

DESCRIPTION OF THE DRAWING

The invention will be better understood upon reading of the following examples made with reference to the accompanying drawings in which.

DESCRIPTION OF THE INVENTION

Figure 1:
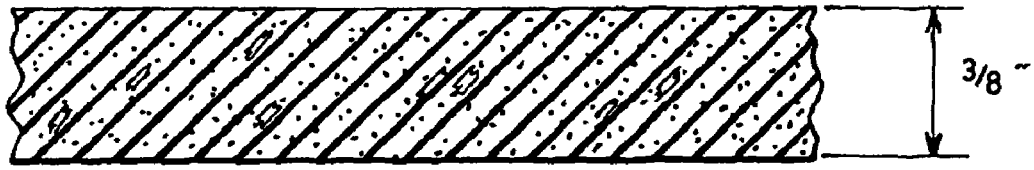
FIG. 1 is a partial cross-section view of a portion of a panel made of a single layer.

The single-layer multi-composite acoustic panel illustrated in FIG. 1 was prepared from a composition containing:

28% of particles of sawdust;

68% of particles of rubber; and

4% of a polyurethane G.N. 405 type G.T. binder.

The panel was prepared at a temperature of about 100° F. (35° C.) under a pressure of about 500 PSI. Its thickness was ⅜ inch (approximately 0.95 cm).

Figure 2:
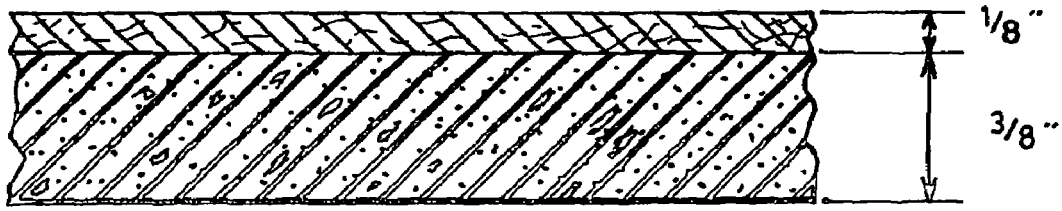
FIG. 2 is a partial cross-section view of a panel made of two layers.
Figure 3:
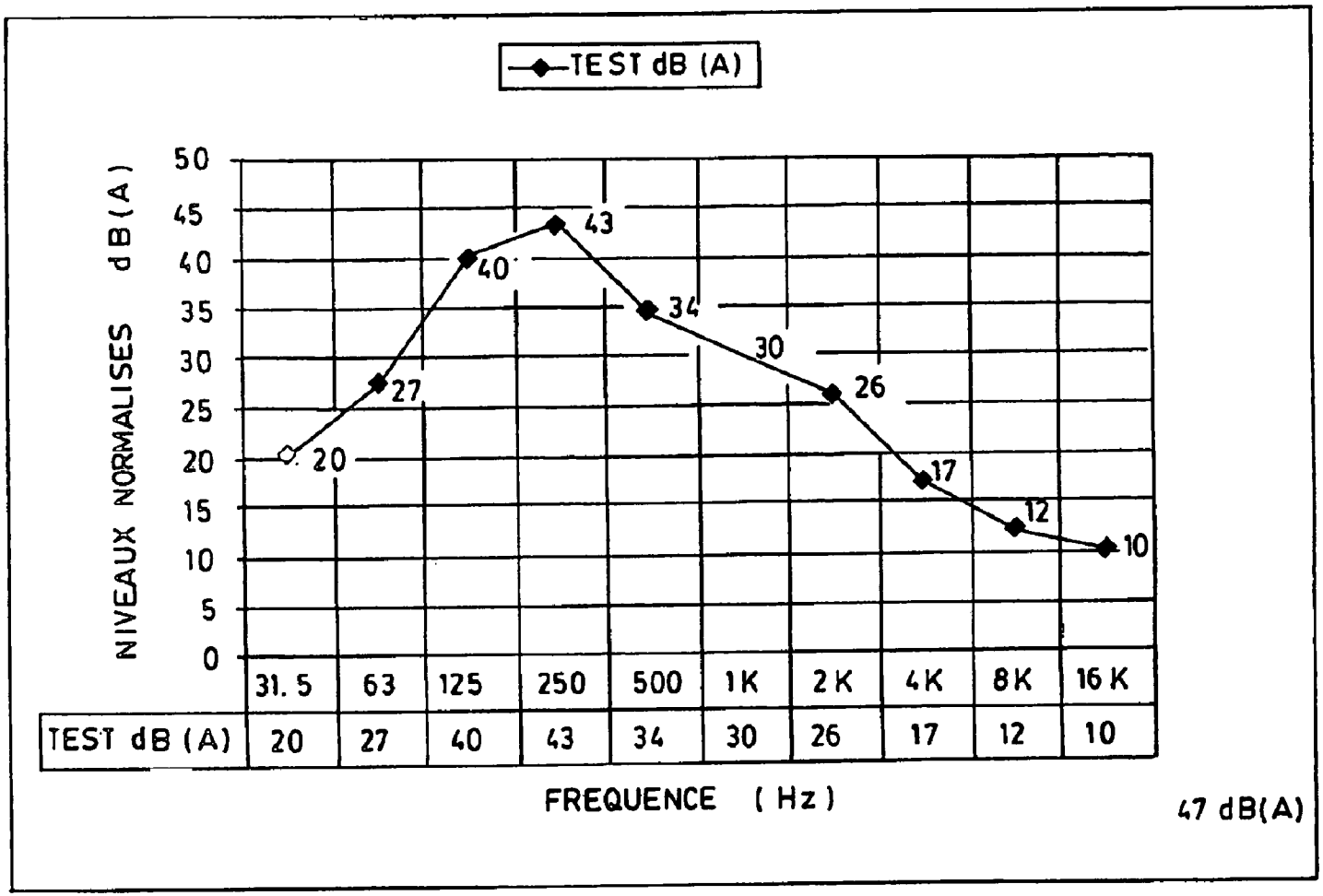
FIG. 3 is a graph giving the result of acoustical tests conducted on the multi-composite acoustic panel according to the invention as illustrated in FIG. 1.

The panel illustrated in FIG. 2 was manufactured from two laminar layers. The main layer was composed of:

28% of particles of sawdust;

68% of particles of rubber; and

4% of a binder (this composition is similar to that of the layer illustrated in FIG. 1).

The thickness of this layer was also the same, that is, ⅜ inch (approximately 0.95 cm).

The second layer laminated onto the first one was manufactured from:

96% particles of sawdust; and

4% of a binder.

The thickness of this second layer was ⅛ inch (approximately 0.3 cm).

Acoustic trials in a building site were conducted on the sample panel illustrated in FIG. 1. The results obtained have proved to be twice those that could have been expected, such coming from the application of two physical advantages including mass principle due to the rubber and spring principle due to the sawdust. Such has thus resulted in a high-level acoustical performance.

The invention is therefore particularly advantageous insofar as it provides multi-composite acoustic panels that are both extremely effective while being less expensive and more ecological since they are obtained from recycling of tires and sawdust. These panels are easy to install and satisfy environmental standards.

It is obvious that numerous modifications could be made to the invention as it has been described while remaining within the scope of the present invention as defined hereinafter in the annexed claims.

The invention claimed is:

1. A multi-composite acoustic panel comprising:

a) particles of sawdust;

b) rubber crumb or other petroleum derivatives or recycled rubber ; and c) an elastomer or polyurethane based binder, wherein:

the particles of sawdust have a granulometry of 4 to 60 mesh and are present in an amount ranging from 15 to 65% by weight with respect to the total weight of the panel;

the rubber crumb or other petroleum derivatives or recycled rubber have a granulometry of 4 to 30 mesh and are present in an amount ranging from 25 to 75% by weight with respect to the total weight of the panel; and the binder is present in an amount ranging from 3 to 20% by weight with respect to the total weight of the panel.

2. The panel according to claim 1, which comprises:

a) 45 to 65% of particles of sawdust;

b) 25 to 45% of rubber crumb or other petroleum derivatives or recycled rubber; and c) 5 to 15% of a polyurethane or elastomer based binder.

3. The panel according to claim l, further comprising:

d) 3 to 8% natural or synthetic fibers, said percentage being expressed by weight with respect to the total weight of the panel.

4. The panel according to claim 3, wherein the natural or synthetic fibers are selected from the group consisting of fibers of polyethylene, polypropylene, polymer, polyurethane, fiberglass, mineral fibers, cellulose fibers, and cork.

5. The panel according to claim 1 which further comprises:

e) 3 to 20% of metal particles in such a way as to give it a radiant capacity, said percentage being expressed by weight with respect to the total weight of the panel.

6. The panel according to claim 5, wherein the metal particles are selected from the group consisting of bronze, copper and aluminum.

7. The panel according to claim 1 which further comprises:

f) particles of at least one additional product selected from the group consisting of —anti fungal, water-repellent, fire-retardant and anti-ant products.

8. The panel according to claim 7, wherein the additional product is a fire-retardant product and said product consists of particles of graphite.

9. The panel according to claim 1 wherein the panel is made of a single layer.

10. The panel according to claim 1, wherein said panel is made of at least two layers made of different compositions.

11. The panel according to claim 1, which further comprises:

d) 3 to 8% natural or synthetic fibers, said percentage being expressed by weight with respect to the total weight of the panel, said material and synthetic fibers being selected from the group consisting of fibers of polyethylene, polypropylene, polymer, polyurethane, fiberglass, mineral fibers, cellulose fibers and cork; and e) 3 to 20% of metal particles in such a way as to give it a radiant capacity; said percentage being expressed by weight with respect to the total weight of the panel, said metal particles being selected from the group consisting of bronze, cooper and aluminum.

12. The panel according to claim 11 which further comprises:

f) particles of at least one additional product selected amongst anti-fungal, water-repellent, fire-retardant and anti-ant products.

13. The panel according to claim 1 wherein said panel is manufactured in a press by a method of thermo-baking at a low temperature ranging between 35° C. and 180° C. under a pressure ranging between 1,400 kN/$m^2$ and 14,000 kN /$m^2$.

14. The panel according to claim 4, wherein said panel is manufactured in a press by a method of thermo-baking at a low temperature ranging between 35° C. and 180° C. under a pressure ranging between 1400 kN/$m^2$ and 14,000 kN/$m^2$.

15. The panel according to claim 6, wherein said panel is manufactured in a press by a method of thermo-baking at a low temperature ranging between 35° C. and 180° C. under a pressure ranging between 1,400 kN/$m^2$ and 14,000 kN/$m^2$.

16. The panel according to claim 11 wherein said panel is manufactured in a press by a method of thermo-baking at a low temperature ranging between 35° C. and 180 ° C. under a pressure ranging between 1,400 kN/$m^2$ and 14,000 kN/$m^2$.

17. The panel according to claim 4, which comprises a) 45 to 65% of particles of sawdust;

b) 25 to 45% of rubber crumb or other petroleum derivatives or recycled rubber; and c) 5 to 15% of a polyurethane or elastomer based binder.

18. The panel according to claim 6, which comprises:

a) 45 to 65% of particles of sawdust;

b) 25 to 45% of rubber crumb or other petroleum derivatives or recycled rubber; and c) 5 to 15% of a polyurethane or elastomer based binder.

19. The panel according to claim 11, which comprises:

a) 45 to 65% of particles of sawdust;

b) 25 to 45% of rubber crumb or other petroleum derivatives or recycled rubber; and c) 5 to 15% of a polyurethane or elastomer based binder.

* * * * *